US005589841A

United States Patent [19]

Ota

[11] Patent Number: 5,589,841

[45] **Date of Patent: *Dec. 31, 1996**

[54] SATELLITE ANTENNA WITH ADJUSTMENT GUIDANCE SYSTEM

[75] Inventor: Takaaki Ota, Englewood, N.J.

[73] Assignees: Sony Corporation, Tokyo, Japan; Sony Electronics, Inc., Park Ridge, N.J.

[ * ] Notice: The term of this patent shall not extend beyond the expiration date of Pat. No. 5,493,310.

[21] Appl. No.: 565,343

[22] Filed: Nov. 30, 1995

Related U.S. Application Data

[63] Continuation of Ser. No. 181,915, Jan. 18, 1994, Pat. No. 5,493,310.

[51] Int. Cl.[6] ..... H01Q 3/02

[52] U.S. Cl. ..... 343/760; 343/840; 343/894

[58] Field of Search ..... 343/760, 840, 343/894, 786, 756; H01Q 19/12, 3/00, 3/02, 3/04, 3/06, 3/08, 3/10

[56] References Cited

U.S. PATENT DOCUMENTS 4,538,175 8/1985 Balbes et al. ..... 343/840
4,554,552 11/1985 Alford et al. ..... 343/840
4,792,812 12/1988 Rinehart ..... 343/840
5,493,310 2/1996 Ota ..... 343/840

OTHER PUBLICATIONS

Baylin et al., "The Home Satellite TV Installation and Troubleshooting Manual", Distributed by Howard W. Sams & Co., 1985, pp. 192–202.

*Primary Examiner*—Michael C. Wimer
*Attorney, Agent, or Firm*—William S. Frommer; Alvin Sinderbrand

[57] ABSTRACT

A satellite dish antenna for receiving a broadcast signal from a satellite includes a low noise block which receives the signal reflected from the dish and provides a human-perceptible guidance signal, such as a sequence of beep tones, to aid an individual in properly orienting the satellite dish with respect to the satellite. A time interval between the beep tones is varied in dependence on the strength of the broadcast signal received at the low noise block. A circuit for providing the guidance signal is activated by a non-contact switch, such as a magnetic lead switch. A magnet is movably mounted on the surface of the low noise block for selectively activating and deactivating the guidance signal circuit.

8 Claims, 6 Drawing Sheets

SATELLITE ANTENNA WITH ADJUSTMENT GUIDANCE SYSTEM

This application is a continuation of application Ser. No. 08/181,915, filed Jan. 18, 1994 now U.S. Pat. No. 5,493,310.

FIELD OF THE INVENTION

This invention relates to satellite earth-station antennas, and, more particularly, to circuitry for assisting in orienting the antenna with respect to a satellite from which a signal is to received.

BACKGROUND OF THE INVENTION

Dish-type satellite antennas are well known, and are increasing coming into use, for example, for reception of direct television broadcast signals from satellites. A typical satellite antenna intended for residential use in receiving direct broadcast television transmissions is schematically illustrated in FIG. 1. As shown in FIG. 1, reference numeral 10 generally indicates the satellite antenna. The satellite antenna 10 includes a support post 12 which extends vertically upwards from a mounting base or bracket (not shown). An antenna assembly 14 is mounted on the support post 12 by means of an adjustable mounting mechanism 16. The antenna assembly 14 includes a signal reflecting dish antenna 18 and a low noise block 20 mounted on a supporting arm 22 at a fixed position in relation to the dish 18.

The dish 18, in a typical home-use embodiment, is about 18 inches in diameter and is curved so as to convergingly reflect the satellite broadcast signal toward the low noise block 20.

As is well known to those skilled in the art, the low noise block 20 includes conventional circuitry (not shown in FIG. 1) including a high-gain, low noise amplifier which receives and amplifies the satellite broadcast signal reflected thereto by the dish 18. The amplified signal is output from the low noise block 20 via a coaxial cable 24. Because the antenna 10 is exposed to the elements, it is highly desirable that the low noise block 20 have an external housing 26 that is durable and sealed so as to be weather-resistant in order to protect the electronic components contained therein.

In a typical installation, the satellite 10 is installed on a rooftop, or elsewhere outside of a residence, and the coaxial cable 24 extends into the residence for connection to a set-top "box" module (not shown) connected as a signal source to a television set (not shown).

In order to provide satisfactory signal reception to the television set, it is necessary to install the satellite antenna 10 so that a signal reception axis of the dish 18 is oriented with reasonable accuracy toward the satellite from which the direct broadcast television signal is to be received. For this purpose, the mounting mechanism 16 includes conventional arrangements, shown only schematically in the drawing, which permit the antenna assembly 14 to be rotated horizontally (as indicated by arrows 28) and vertically (as indicated by arrows 30) with respect to the support post 12. Scale markings 32, for indicating the vertical rotational elevation of the antenna assembly 14, are also typically provided.

For optimum adjustment of the orientation of the dish 8 relative to the satellite, it is known to provide a circuit in the aforementioned set-top unit for detecting the strength (i.e., the amplitude) of the received satellite signal and for controlling the television set so that a bar graph or similar display indicative of the signal strength is provided on the television screen. The amplitude measurement and display function may be actuated, for example, by selection of a menu item, using a remote control device provided to control the set-top unit and with reference to a menu displayed on the television screen. Essentially, the orientation of the dish 18 is adjusted on a trial-and-error basis until a maximum received signal amplitude is indicated on the television screen display.

The above-described technique of displaying an indication of the received signal amplitude on the television screen suffers from a number of disadvantages. As noted before, the satellite antenna 10 is usually installed outside of the building, and perhaps on the roof. Thus, the location at which the orientation adjustments are to be made (i.e., at the satellite antenna 10) is physically remote from the television screen on which the amplitude indication is displayed. If an individual attempts to adjust the orientation of the antenna assembly 14 without assistance, the orientation adjustment may require numerous trips by the individual back and forth between the satellite antenna 10 and the vicinity of the television screen for the purpose of alternately adjusting the antenna's orientation and determining the resulting effect on received signal amplitude by referring to the television screen display. Such a procedure may be particularly arduous if the satellite antenna 10 is installed on the roof of the building.

Even if two or more people participate in the task of adjusting the antenna orientation, there may be significant inconvenience, including difficulty in communicating instructions such as "up", "down", "left", "right", etc., from a person who is in a position to view the television screen to another person who is in a position to physically manipulate the satellite antenna 10 to adjust the orientation of the antenna assembly 14.

A further disadvantage is that the known technique as described above does not allow pre-positioning of the satellite antenna 10. In other words, the above-described technique cannot be used unless both a working television receiver and set-top unit are available and connected to the satellite antenna 10.

OBJECTS AND SUMMARY OF THE INVENTION

Accordingly, it is an object of the present invention to facilitate adjustment of the orientation of a satellite antenna by providing a conveniently accessible indication of the amplitude of a satellite signal received by the satellite antenna.

It is another object of the present invention that the amplitude indication be provided without compromising the weather-resistant integrity of the antenna's low noise block.

It is still another object of the invention that a function for providing the amplitude indication be actuatable conveniently and without compromising the integrity of the low noise block.

In accordance with the invention, there is provided a satellite antenna which includes a support, and an antenna assembly adjustably mounted on said support and including a housing, a low noise amplifier within the housing for receiving and amplifying a satellite broadcast signal, and a dish antenna arranged with respect to the low noise amplifier so as to convergingly reflect the satellite broadcast signal toward the low noise amplifier. The satellite antenna also includes an adjustment guidance device provided within the housing for emitting an adjustment signal that is indicative of a characteristic of the satellite broadcast signal received by the low noise amplifier.

According to a further aspect of the invention, the adjustment signal emitted by the adjustment guidance device is perceptible to an individual who is in physical contact with the satellite antenna for the propose of adjusting the orientation of the antenna assembly. For example, the adjustment signal may be in the form of sounds that are audible to the individual in contact with the antenna. According to still a further aspect of the invention, the adjustment signal is provided as a sequence of audible tones, with the interval between the tones being varied in dependence on the characteristic of the satellite broadcast signal received by the low noise amplifier.

According to still further aspects of the invention, a switch is provided for selectively activating the adjustment guidance device and the switch is of a non-mechanical type and is provided within the housing. The switch may be a magnetic lead switch controlled by a magnet mounted for movement on the surface of the housing between a first position for activating the adjustment guidance device and a second position for deactivating the adjustment guidance device.

According to another aspect of the invention, there is provided a satellite antenna including a support, an antenna assembly mounted on the support for horizontal rotation and for vertical rotation with respect to the support, the antenna assembly including a water-proof sealed housing, a low noise amplifier within the housing for receiving and amplifying a satellite broadcast signal, and a dish antenna arranged with respect to the low noise amplifier so as to convergingly reflect the satellite broadcast signal toward the low noise amplifier. According to this aspect of the invention, the satellite antenna also includes an adjustment guidance circuit provided within the housing for emitting an adjustment signal that is indicative of a characteristic of the satellite broadcast signal received by the low noise amplifier and a magnetic lead switch provided within the housing and associated with the adjustment guidance circuit for selectively activating the adjustment guidance circuit.

By providing a satellite antenna as described above, adjustment of the orientation of the antenna to receive a satellite broadcast signal at an optimum amplitude can be easily and conveniently performed by a single individual on the basis of a human-perceptible received-signal amplitude indication in the immediate vicinity of the satellite antenna. The adjustment signal function can be readily activated by a person who is positioned near the satellite antenna and via a mechanism that does not compromise the integrity of the housing for the satellite antenna's low noise block.

The above, and other objects, features and advantages of the present invention will be apparent from the following detailed description thereof which is to be read in connection with the accompanying drawings.

DETAILED DESCRIPTION OF THE PREFERRED EMBODIMENTS

Figure 1:
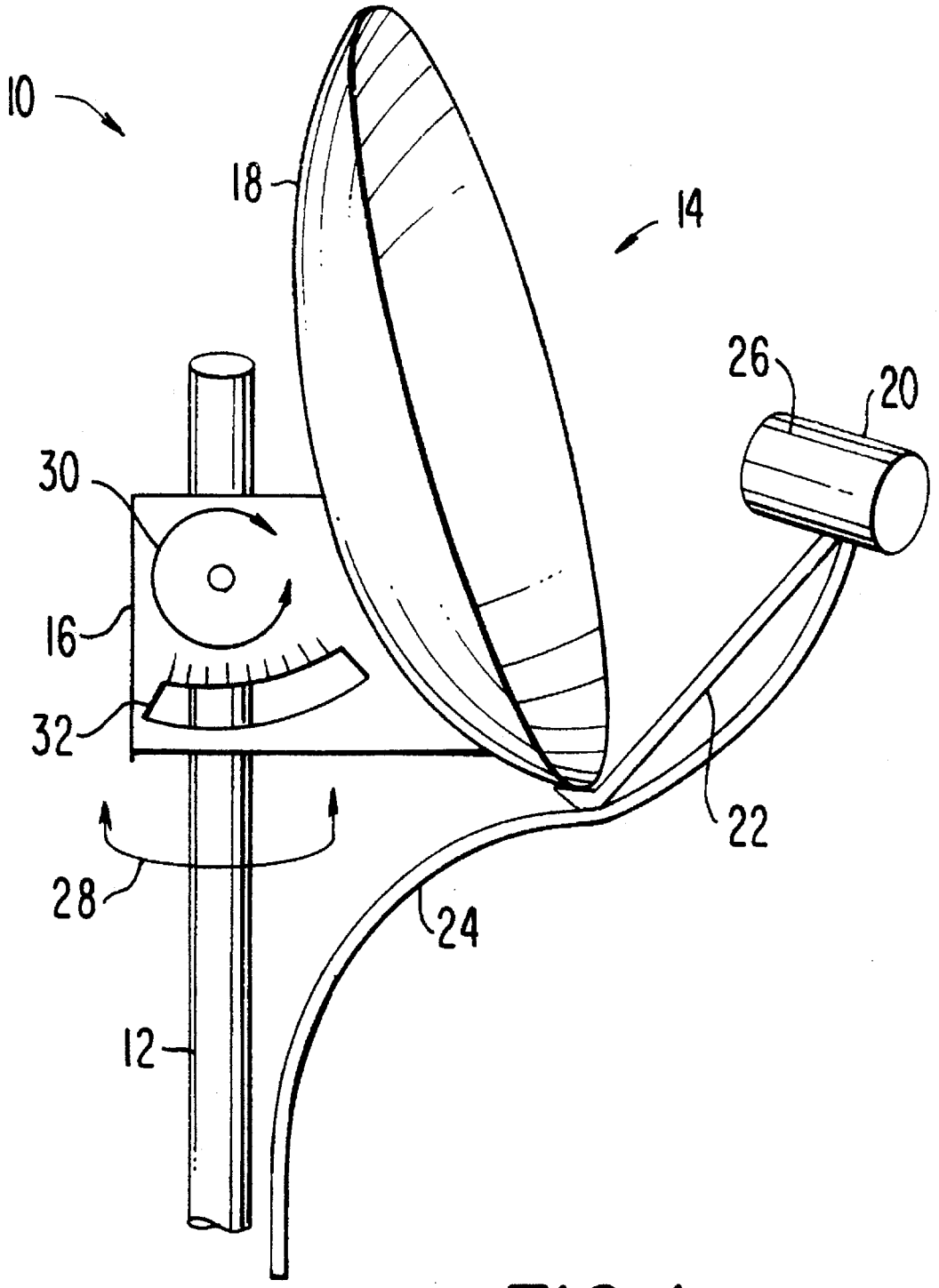
FIG. 1 PRIOR ART
FIG. 1 is a schematic illustration of a conventional home-use satellite antenna used for receiving satellite direct broadcast television signals.
Figure 2:
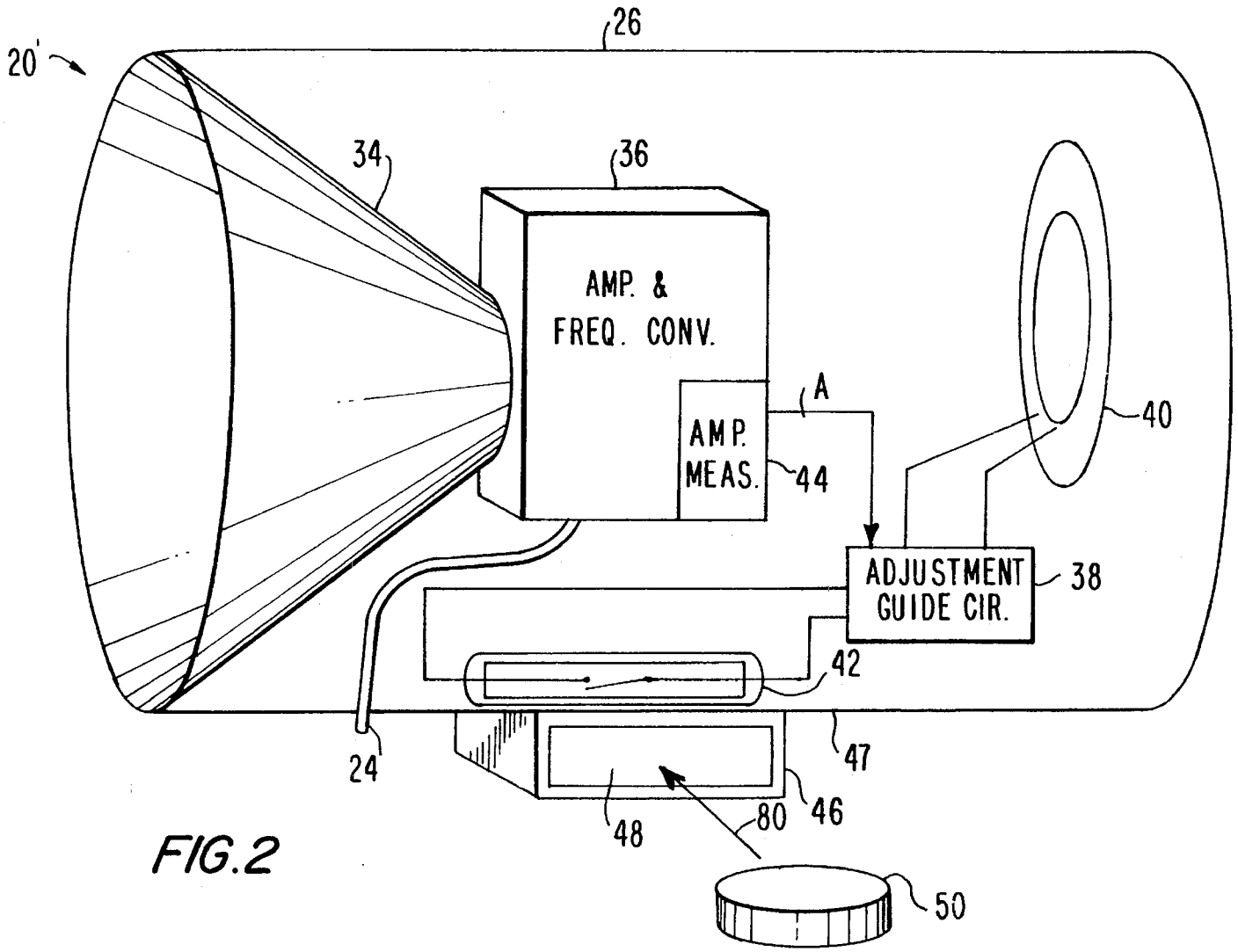
FIG. 2 is a schematic illustration of major components of a low noise block for a direct broadcast television satellite antenna in accordance with the present invention.

According to the invention, there is provided a satellite antenna 10 like the conventional antenna shown in FIG. 1, except that the low noise block 20 thereof is replaced with a low noise block 20' arranged in accordance with the invention, as shown in FIG. 2. The low noise block 20' of FIG. 2 includes a conventional sealed, water-proof housing 26 for protecting components contained therein from damage by the elements, etc. Within the housing are provided a signal receptor 34, a low noise amplifier and frequency conversion circuit 36, an adjustment guide circuit 38, a sound producing device such as a piezoelectric speaker 40, and a magnetic lead switch 42. The signal receptor 34 is a conventional arrangement for providing the satellite signal reflected from the dish 18 (FIG. 1) to the amplifier and frequency conversion circuit 36. Continuing to refer to FIG. 2, the amplifier and frequency conversion circuit 36 is also of conventional design, except that it includes a received signal strength measurement circuit 44 which outputs a received amplitude measurement signal A to the adjustment guide circuit 38. The amplitude measurement signal A is preferably an analog voltage level proportional to the strength of the satellite signal received at the low noise block 20'. Further description of the measurement circuit 44 is not believed to be necessary, since provision of the same is well within the abilities of those skilled in the art. For example, the amplitude measurement circuit 44 may be of the type provided in a conventional set-top unit for generating a signal representative of the strength of the received satellite signal.

The adjustment guide circuit 38 is connected to the piezoelectric speaker 40 and controls the speaker 40 in response to the amplitude measurement signal A provided thereto by the measurement circuit 44. The magnetic lead switch 42 is connected to the adjustment guide circuit 38 for the purpose of selectively activating and deactivating the adjustment guide circuit 38. The magnetic lead switch 42 is normally in an open position (as shown in FIG. 2), which is the position for deactivating the adjustment guide circuit 38.

A slot pocket 46 is formed, or fixedly mounted, on an outer surface 47 of the sealed low noise block housing 26. The slot pocket 46 is configured to form a slot 48, which is shaped and sized to accommodate a magnet 50. The magnet 50 may be selectively inserted in, and removed from, the slot 48. The slot pocket 46 is positioned on the surface 47 of the low noise block housing 26 proximately to the position of the magnetic lead switch 42 within the sealed housing 26. When the magnet 50 is received within the slot 48, the resulting proximity of the magnet 50 to the magnetic lead switch 42 causes the magnetic lead switch 42 to assume a closed position, which is the position for activating the adjustment guide circuit 38. Accordingly, the adjustment guide circuit 38 is selectively activated and deactivated by insertion and removal, respectively, of the magnet 50 into and from the slot 48.

Figure 3:
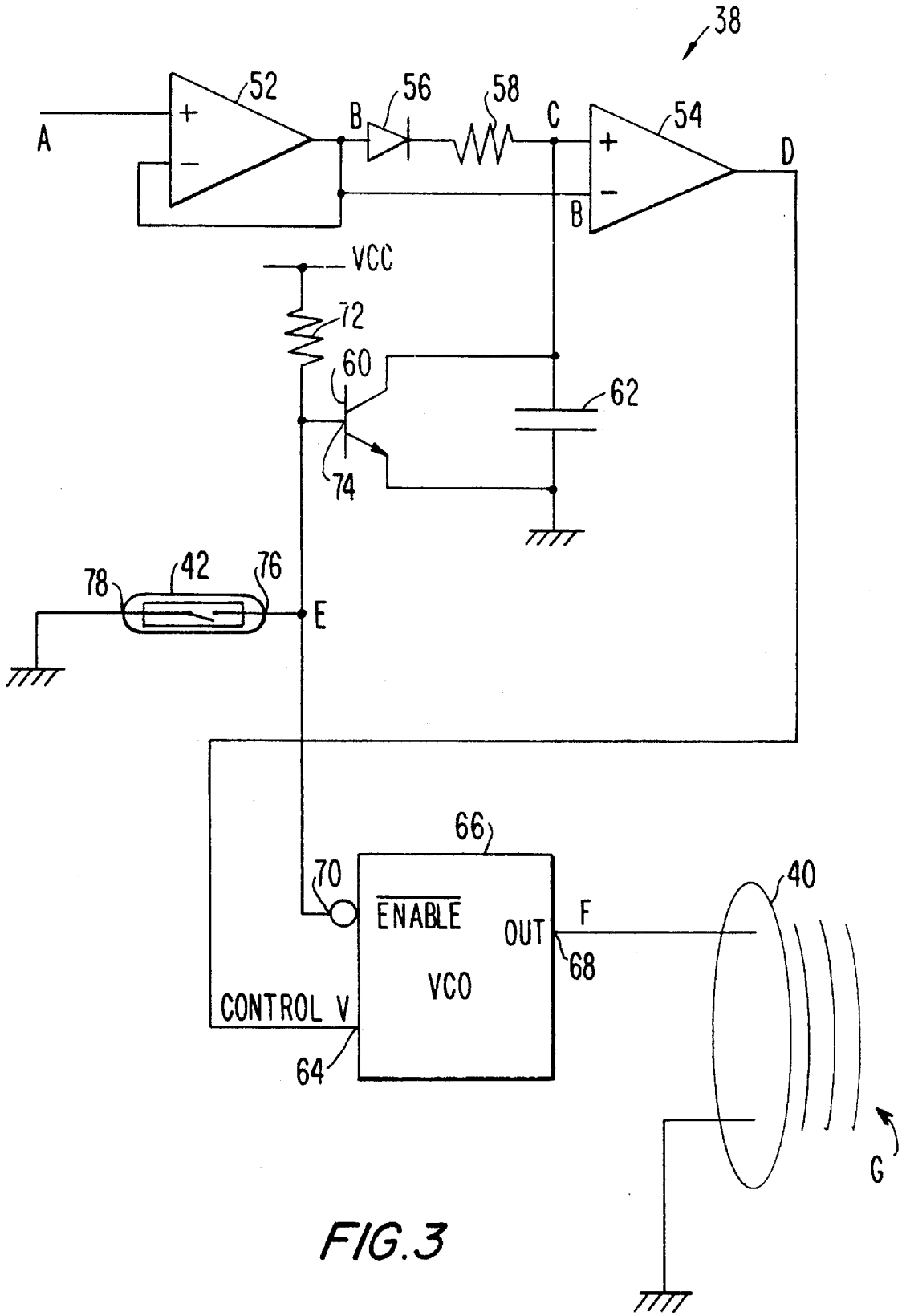
FIG. 3 is a schematic diagram of a circuit included in the low noise block of FIG. 2 for providing an adjustment guidance signal.

FIG. 3 illustrates details of the adjustment guide circuit 38, including the connections of the circuit 38 with the magnetic lead switch 42 and the piezoelectric speaker 40. As shown in FIG. 3, the amplitude measurement signal A, which is representative of the strength of the satellite broadcast signal received at the amplifier 36, is supplied to a non-inverting terminal of a buffer amplifier 52. An output terminal of the amplifier 52 is connected directly to an inverting input terminal of a differential amplifier 54. The output of the buffer amplifier 52 is also connected to a non-inverting input of the differential amplifier 54 through a diode 56 and a resistor 58 connected in series.

The non-inverting input of the differential amplifier 54 is connected to ground through a transistor 60 and a capacitor 62, connected in parallel. An output terminal of the differential amplifier 54 is connected to an input terminal 64 of a voltage controlled oscillator (VCO) 66. An output terminal 68 of the VCO 66 is connected to provide a driving signal F to the piezoelectric speaker 40. The piezoelectric speaker 40, in turn, outputs an audible guidance signal G in response to the driving signal F output from the VCO 66.

VCO 66 has an "active low" enable terminal 70 which is connected in common to a pull-up resistor 72, a base terminal 74 of the transistor 60, and a terminal 76 of the magnetic lead switch 42. The magnetic lead switch 42 has another terminal 78 which is grounded.

The buffer amplifier 52 and the differential amplifier 54 may both be formed by means of a respective operational amplifier of a standard type. Buffer amplifier 52 may be arranged as a voltage follower that provides unity gain or, alternatively, may provide a gain factor other than unity. Differential amplifier 54 is arranged so that its output signal D has a level that is equal or proportional to the difference between the respective levels of the signal C provided at its non-inverting input and the signal B provided at its inverting input.

VCO 66 may be a conventional voltage controlled oscillator with an output signal F that oscillates at a frequency which is dependent on the amplitude of the input signal Control V provided at the input terminal 64 of VCO 66. It will be noted that the input signal Control V for VCO 66 is the same as the difference signal D output from the differential amplifier 54. According to this arrangement, the frequency of the driving signal F output from VCO 66 will vary with the difference signal D so that the difference signal D controls the tone frequency of the audible guidance signal G emitted by the speaker 40.

In operation, the adjustment guidance circuit 38 includes a peak hold function which detects and holds a maximum level C of the buffered amplitude measurement signal B. The difference signal D is provided as the difference between the peak level C and a present level of the buffered amplitude measurement signal B.

When magnetic lead switch 42 is in its normal open position for disabling the adjustment guidance circuit 38, a control signal E at the terminal 76 of the magnetic lead switch 42 is at a "high" logic level so that the VCO 66 is disenabled, and the transistor 60 is in conduction, thereby grounding the non-inverting terminal of the differential amplifier 54 and forcing to zero the levels of the peak signal C and the differential signal D. When the magnet 50 (FIG. 2) is inserted as indicated by the arrow 80 into the slot 48 proximate to the magnetic lead switch 42, then the magnetic lead switch 42 is placed in a closed condition for activating the adjustment guide circuit 38. Thus, and referring again to FIG. 3, the level of the control signal E at the terminal 76 of the magnetic lead switch 42 becomes a "low" level so that the VCO 66 is enabled. At the same time, the transistor 60 is taken out of conduction, so that the non-inverting terminal of the differential amplifier 54 is connected to ground only through the capacity 62.

As will be seen, the adjustment guidance circuit 38 is used for an antenna orientation adjustment operation in which the position of the antenna is adjusted toward and then past an optimum position. The adjustment guidance circuit 38, by emitting the guidance signal G, alerts the individual performing the adjustment operation that the antenna has been moved past the optimum position, and the signal G also guides the individual so that the antenna can be moved back to the optimum position.

In particular, as the buffered amplitude measurement signal B increases in level from an initial value (assumed for the purpose of this discussion to be zero), the level of the peak signal C follows, except that the level of the peak signal C is slightly lower than the level of the signal B by the amount of the voltage drop across the diode 56. Also, the resistor 48 and capacitor 62 form a low pass filter so that an increase in level of the signal C is delayed in time with respect to the corresponding increase in the level of signal B. The values of the resistor 58 and capacitor 62 are selected to provide a time constant for the low-pass filter formed thereby that is short enough to provide a prompt response to changes in the antenna position, while minimizing the effect of short-term fluctuations in the level of signal B.

So long as the level of signal B is stable or increasing, the level of the difference signal D remains at a minimum level that may be, for example, zero or just below. However, when the antenna is moved past its optimum position, the level of signal B begins to decrease from its maximum level provided at the optimum position of the antenna, while the level of the signal C is held at its maximum by the capacitor 62 and the diode 56 so that the difference signal D begins to increase from its minimum level. The increase in the level of the difference signal D (received as the input signal Control V at the VCO 66), causes a change in the audible guidance signal G. For example, the VCO 66 may operate so that a constant low frequency audible tone is provided when the difference signal D is at its minimum level and that the tone frequency increases as the level of the difference signal D increases. When the individual adjusting the antenna's orientation perceives the change in tone, the individual then reverses the direction of adjustment of the antenna so that the antenna is moved back toward its optimum orientation, resulting in a decrease in the level of the difference signal D (because of the increase in the level of the signal B), and a corresponding decrease in the tone frequency of the audible guidance signal G.

Figure 4:
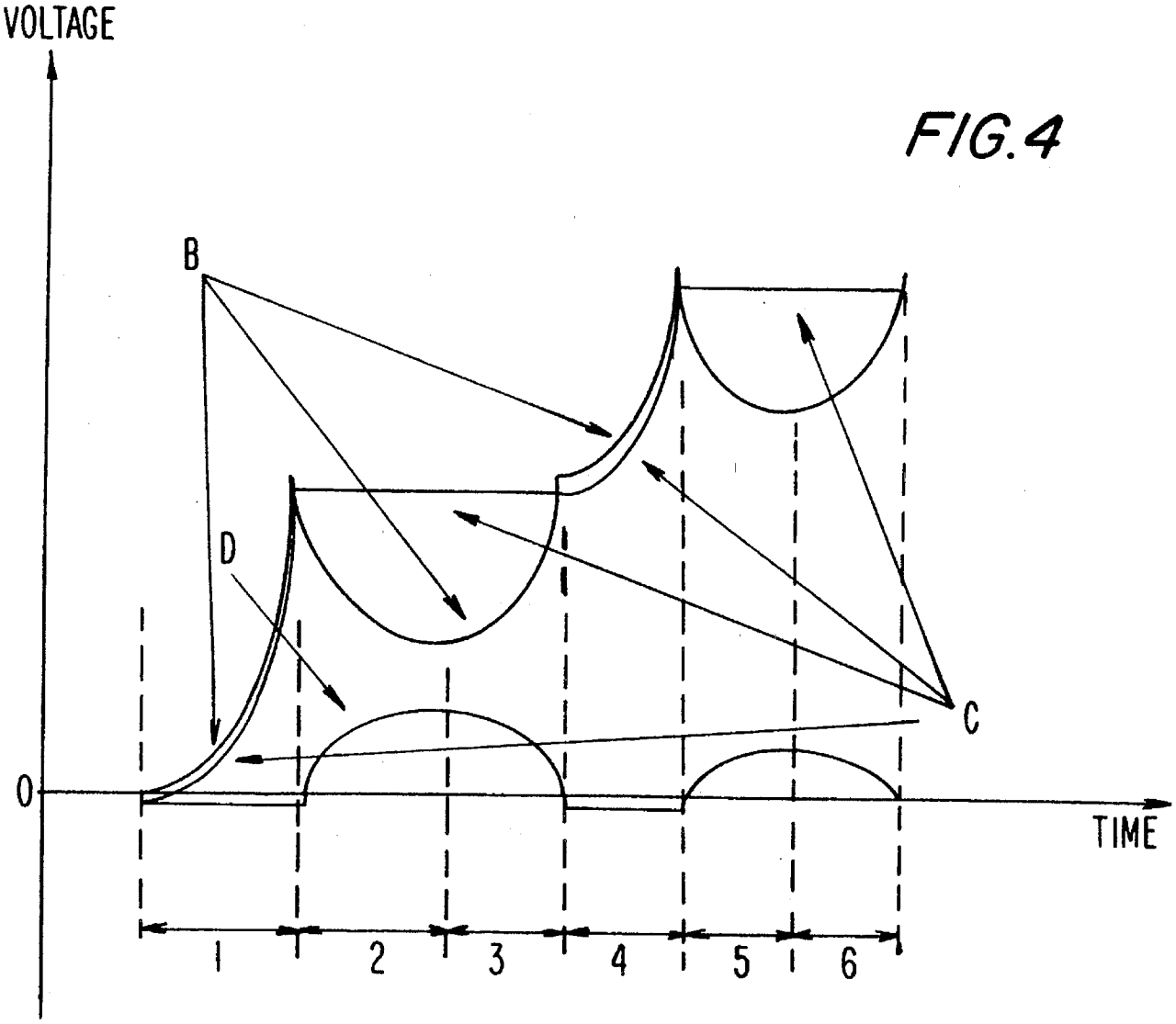
FIG. 4 is a waveform diagram illustrating levels of various signals present in the circuit of FIG. 3 during adjustment of the orientation of the satellite antenna.

FIG. 4 is a wave form diagram which illustrates respective levels of signals B, C and D during a typical antenna orientation adjustment procedure. In FIG. 4, time intervals 1–6 are indicated by respective double headed arrows arranged along the time axis. The time intervals 1–3 together represent a period during which the orientation of the antenna is adjusted by vertical rotation, while the time intervals 4–6 represent a period during which the antenna is adjusted by horizontal rotation. During the time interval 1, the antenna is vertically rotated in a first direction toward an optimum vertical orientation. Accordingly, the level of signal B increases, and the level of signal C follows at a slightly lower level and with a slight time delay.

At the beginning of time interval 2, the continuing vertical rotation of the antenna in the first direction takes the antenna past its optimum vertical orientation so that the level of signal B declines while the level of signal C is held steady at its maximum, and the level of signal D rises from its minimum level. The rise in the level of signal D causes a change in the audible guidance signal G. The change in the guidance signal G is perceived by the individual performing the adjustment, who, at a time indicated as the beginning of time interval 3 on FIG. 4, reverses the direction of vertical rotation so that the level of signal B increases and the level of signal D decreases during time interval 3. Time interval 3 is shown as ending at the point at which the guidance signal G has returned to its normal state, as perceived by the individual, with the antenna having been vertically rotated back to its optimum vertical position, at which the level of signal B is again at its previous maximum.

With the optimum vertical orientation having been established, the individual proceeds to perform a horizontal rotational adjustment during the time periods 4, 5 and 6. It will be noted that the level of signal B, followed by the level of signal C, again increases during period 4, but this time from their respective levels as of the end of time period 3. Time interval 5 represents a period during which the horizontal rotation of the antenna is in the same direction as in interval 4, but since the optimum position was reached at the end of interval 4, the rotation is away from, rather than toward the optimum point. Again the level of difference signal D rises (with the level of signal C remaining steady) during interval 5, so that the individual performing the adjustment is alerted to the fact that the optimum point has been passed. Accordingly, during interval 6 the antenna is horizontally rotated in a reverse direction until the overall optimum position, providing the highest level of signal B, is reached.

It will be appreciated that the adjustment guidance mechanism as described above provides for a convenient and simple adjustment procedure that can be readily initiated and carried out by an untrained individual, without assistance from other people.

Although the adjustment guidance circuit 38 discussed above is provided with a speaker 40 in order to produce an audible adjustment guidance signal, the present invention is not limited to an audible signal, and it is within the contemplation of this invention to provide any type of adjustment guidance signal that is perceptible to an individual who is physically touching, or proximate to, the antenna 10. However, an audible adjustment guidance signal is preferred because the individual performing the antenna orientation adjustment can attend to an audible guidance signal without shifting his visual focus from the activity of his hands with respect to the mechanism for adjusting the orientation of the antenna.

Although the embodiment of the low noise block shown in FIG. 2 has a slot pocket 46, into which a magnet 50 may be inserted for activating the adjustment guide circuit 38 and from which the magnet 50 may be entirely removed for deactivating the adjustment guide circuit 38, it is alternatively contemplated to provide convenient embodiments in which the magnet used for activating and deactivating the adjustment guide circuit 38 remains connected to, and is movably mounted on, the low noise block.

Figure 5B:
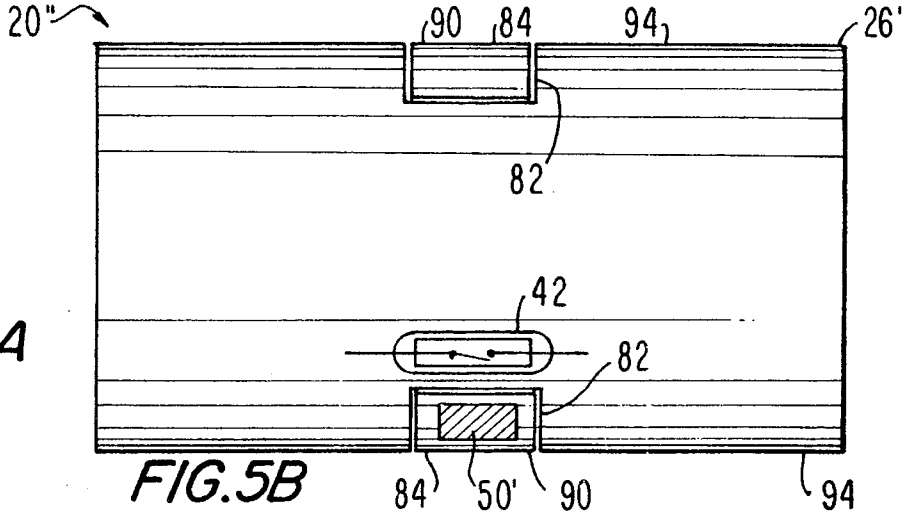
FIGS. 5A–5E illustrate alternative ways in which a magnet may be mounted on a low noise block for activating an adjustment guidance circuit in accordance with the invention.
Figure 5D:
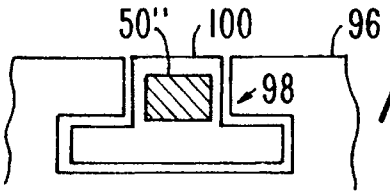
Figure 5E:
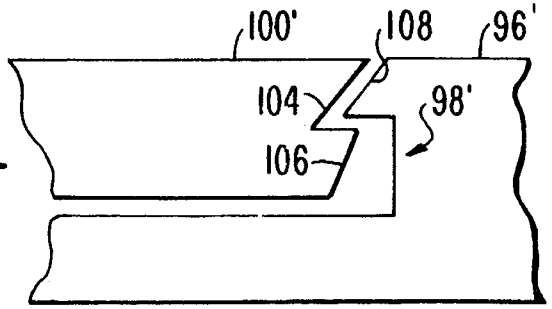
Figure 5A:
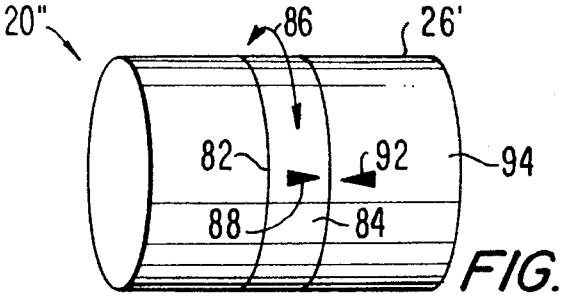

For example, FIGS. 5A and 5B are respectively a perspective and a sectional view of a first such embodiment. In the embodiment of FIGS. 5A and 5B, a low noise block 20" is shown as having a substantially cylindrical sealed exterior housing 26'. The housing 26' has formed therein a generally annular channel 82 which girdles a circumference of the housing 26'. A ring member 84 is accommodated within the annular channel 82 in such a manner that the ring member 84 may be slidingly rotated in either of two circumferential directions of the housing 26', as indicated by arrows 86 (FIG. 5A). The ring member 84 may be formed of a molded plastic, for example, and has embedded therein a magnet 50' to be used for selectively activating and deactivating the magnet switch 42 forming part of the remaining circuitry (not shown in FIGS. 5A and 5B) sealed within the housing 26'. Preferably, an indication mark 88 is formed on an exterior surface 90 of the ring member 84 and a matching indicator mark 92 is formed on an outer surface 94 of the low noise block housing 26'. The indication mark 88 is positioned on the ring member 84 relative to the magnet 50'. and the indication mark 92 is positioned on the housing 26' relative to the magnetic lead switch 42, such that, if the indication marks 88 and 92 are aligned, then the magnet 50' is positioned proximate to the magnetic lead switch 42 for activating the adjustment guide circuit 38. It will be recognized that the ring member 84 may be rotatively moved so that the indication marks 88, 92 are no longer aligned, thereby placing magnet 50' in a position for deactivating the adjustment guide circuit 38.

Alternative embodiments of a low noise block housing, having the adjustment function actuator magnet mounted thereon, will now be described with reference to FIGS. 5C–5E.

Figure 5C:
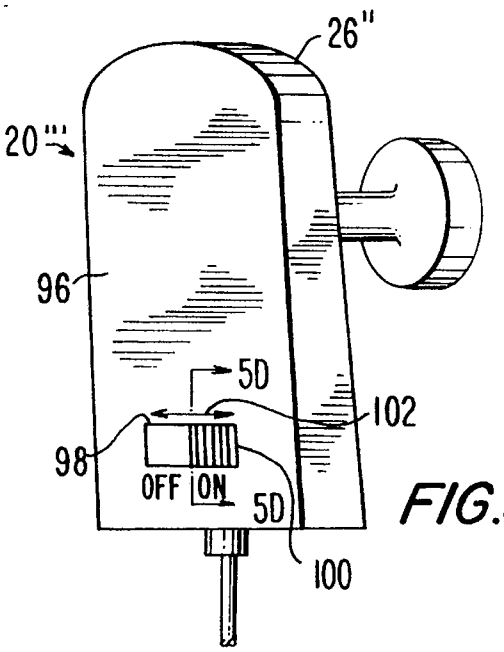

FIG. 5C is a perspective view of a low noise block 20''' according to an alternative embodiment of the invention. The low noise block 20''' has the same internal components as those described with reference to the low noise block 20' of FIG. 2, but the low-noise block 20''' of FIG. 5C has an external housing 26" which is shaped differently from that of the embodiments of FIG. 2 and FIGS. 5A, 5B.

In particular, the housing 26" has a flat rear surface 96. A linear channel 98 is formed in the rear surface 96 of the housing 26" for slidably accommodating therein a magnet member 100. The magnet member 100 has a magnet 50" embedded therein for selectively activating and deactivating the adjustment guide circuit 38 of the low noise block 20'''. The magnet member 100 is slidable in the directions indicated by the double arrow 102 between an "on" position for activating the adjustment guide circuit 38 and an "off" position for deactivating the adjustment guide circuit 38. FIGS. 5D and 5E show alternative cross-sectional arrangements for the magnet member 100 and the channel 98, with the cross-section being understood to have been taken as indicated by the line D—D in FIG. 5C (i.e., in a direction transverse to the directions indicated by the arrow 102). In the embodiment shown in FIG. 5D, it will be seen that the magnet member 100 and the channel 98 have corresponding cross-sections of an inverted "T" shape. In a preferred modification shown in FIG. 5E, the cross-sectional profile of the channel and the magnet member are arranged to allow for snap-fitting of the magnet member into the channel during assembly of the low noise block. In particular, the magnet member 100' has inclined surfaces 104 and 106 and the channel 98' has an inclined surface 108 for guiding the surface 106 during assembly of the low noise block.

Other magnet-mounting approaches besides those shown in FIGS. 5A–5E are also contemplated by the invention, including, for example, mounting a ring- or disk-shaped magnet member for rotation on a flat surface of the low-noise block housing.

Further, although the adjustment guide circuit 38 is preferably activated and deactivated by means of a magnetic lead switch, as previously described, it is within the contemplation of the invention to use other types of switches, including, for example, another type of switch in which there is no mechanical connection between the switch itself and an element manipulated by an individual for changing the state of the switch (hereinafter "non-mechanical switches"). For example, it is contemplated to use switches actuated by means of light, sound, radio or infra-red waves.

It is also contemplated to activate the adjustment guidance circuit 38 by means an activation signal transmitted to the low noise block via the coaxial cable 24. For example, such an activation signal may be transmitted from a set-top unit connected to the low noise block by the coaxial cable 24.

It will be recalled that, in an embodiment of the invention that has been previously described, the tone frequency of the adjustment guide signal G was varied in response to changes in the level of the difference signal D output from the differential amplifier 54 (FIG. 3). However, it is also contemplated to provide other types of variation in the audible guidance signal G in response to changes in the level of the difference signal D. For example, according to an alternative embodiment of the invention, the audible guidance signal G consists of a sequence of beep tones, with each beep tone having the same duration and tone frequency, but with time intervals between the tones being varied in length in response to changes in the level of the difference signal D.

Figure 6:
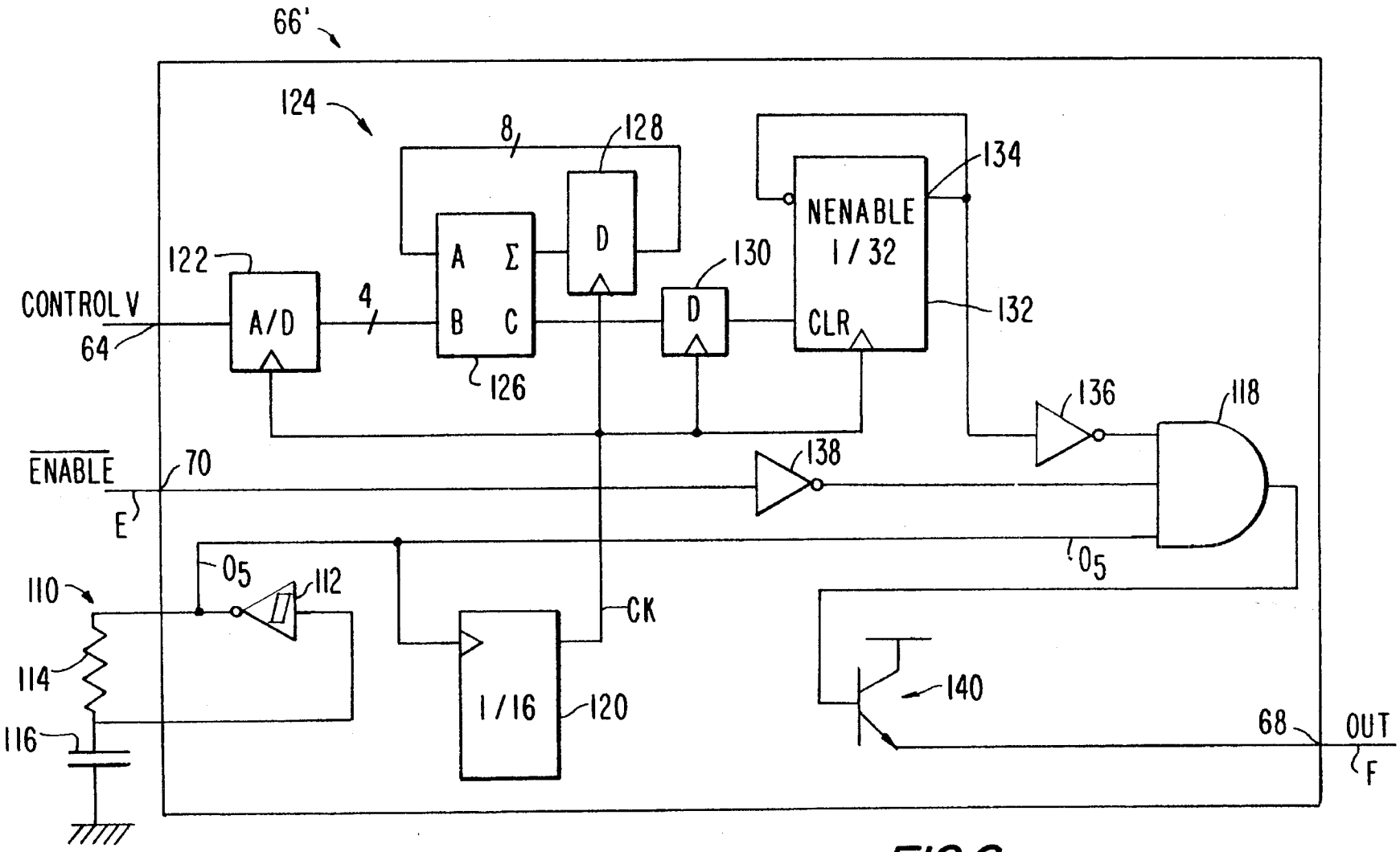
FIG. 6 is a schematic block diagram of a voltage controlled oscillator and beeper driver circuit that may be used in the adjustment guidance circuit of FIG. 3.

A voltage controlled oscillator circuit 66' to be used in the latter embodiment of the invention will now be described with reference to FIG. 6. As shown in FIG. 6, the VCO circuit 66' includes an oscillator 110 formed of a Schmitt trigger 112, a resistor 114 and a capacitor 116. The oscillator 110 is arranged to provide an output signal $O_s$ that oscillates at a frequency in the range of about 300–600 Hz. As will be seen, the frequency of output signal $O_s$ from the oscillator 110 determines the tone frequency of the adjustment guidance signal G. The range of 300–600 Hz is selected as a frequency range in which the human auditory system is quite sensitive.

The output signal $O_s$ is supplied to one input of a three input AND gate 118 and is also supplied to a 1/16 frequency divider circuit 120 (e.g., a 4-bit counter), which outputs a frequency-divided signal as a circuit clock signal CK. The input signal Control V (which is the difference signal D) received at input terminal 64 is provided to a 4-bit analog to digital converter 122. The 4-bit digital output of the A/D converter 122 is provided as an input signal to an accumulator 124 that is formed by an adder 126 and an 8-bit data latch 128. In particular, the 4-bit data output from the A/D converter 122 is provided to one input terminal of the adder 126. Another input terminal of the adder 126 receives a summation output of the adder 126 by way of the 8-bit latch 128. A carry output terminal of the adder 126 is connected through a one-bit data latch 130 to the clear terminal of a 5-bit counter 132. The clock signal CK output from the frequency divider 120 is provided to respective clock terminals of the A/D converter 122, the latches 128 and 130, and the counter 132. The counter 132 is arranged so that each time it is cleared, it outputs a logic "low" signal at its output 134 for a period of 32 clock cycles of the clock signal CK. At the end of the 32 clock cycle period, the signal output at terminal 134 becomes a logic "high" level and remains at a "high" level until a "low" level is again asserted at the clear terminal of the counter 132. In other words, each time the counter 132 is cleared, it counts up from 0 to 31, and then stops counting, and the counter 132 outputs a "low" level, while, but only while, it is counting.

The output-terminal 134 of the counter 132 is connected through an inverter 136 to a second input of the AND gate 118, and the on/off control signal E received at enable terminal 70 is connected to a third input terminal of the AND gate 118 through an inverter 138.

The output of the AND gate 118 is connected to the base of a beeper-driver transistor 140.

In operation, the piezoelectric speaker 40 (FIG. 3) is driven to produce a tone at the frequency of the oscillation signal $O_S$ at times when the control signal E is active and the counter 132 is outputting a "low" level, i.e., when the counter 132 is counting up. The duration of each beep is set by the counter 132 and, assuming that the signal $O_S$ has a frequency of about 500 Hz, the duration of each beep is about 1 second.

Each beep is produced in response to a "carry" signal output from the adder 126, and the carry signal is produced each time when the accumulator 124 overflows. How frequently the accumulator 124 overflows, and consequently the length of the time interval between beeps, depends on the value of the 4-bit data output from the A/D converter 122 to the adder 126. For example, when the input signal Control V is at its minimum level (the difference signal D is at its minimum level), the output of the A/D converter 122 is '0000', so that the accumulator 124 never overflows and no beeps are produced. On the other hand, for relatively large values of the output from the A/D converter 122, the accumulator 124 overflows often and beeps are produced at short time intervals. The time interval between beeps is inversely proportional to the value of the A/D converter output. As a result, the time interval between the beep tones of the guidance signal G become shorter as the difference signal D increases in level.

Returning now to the exemplary antenna orientation adjustment operation described above with reference to FIG. 4, during the time interval 1 shown in FIG. 4 the difference signal D is at its minimum level and no beeps are produced. During the time interval 2, the difference signal D increases so that beeps are produced increasingly often, but during the time interval 3 the difference signal D decreases in level, so that the rate at which the beeps are produced is decreased until the beeps stop at the time when the antenna has been adjusted to an optimum orientation.

Although a piezoelectric speaker device is a preferred choice for the speaker 40 because of its durability, resistance to changes in temperature and low cost, it is nevertheless contemplated that another type of speaker, such as a conventional magnetic speaker, could be used.

Also, although the adjustment guidance circuit described herein is well suited for a small, low cost satellite antenna in which orientation adjustment is performed manually, the adjustment guidance circuit could also be used in a motorized satellite antenna, in which one or more motors provide the force for the rotational adjustments of the antenna. The actuation of the motor or motors may be performed manually by an individual in response to a human-perceptible guidance signal, such as those previously described herein, or alternatively the difference signal D output from the differential amplifier 54 could be used as a feedback signal for automatically controlling a motorized antenna orientation adjustment system. In that case, the circuitry for generating the audible guidance signal from the difference signal, including the VCO 66 and the speaker 40, could be omitted.

Further, although it is preferred that the vertical rotational adjustment of the antenna be performed before the horizontal rotational adjustment, it is possible to interchange the order of the vertical and horizontal rotational adjustments.

It should also be noted that for a satellite antenna in which the low noise block receives its power from a set-top unit connected thereto through a coaxial cable, it is contemplated to provide an auxiliary power source for connection to a low noise block that is not connected to a set-top unit so that the antenna can be "pre-positioned" by an orientation adjustment according to the techniques described herein, at a time when there is no set-top unit available, or the satellite antenna has not yet been connected to a set-top unit.

It should also be understood that the invention is applicable to antennas used for receiving other types of signals in addition to or instead of television signals.

Having described specific preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A satellite antenna comprising:

a support;

an antenna assembly adjustably mounted on said support and exhibiting a changeable orientation with respect to a satellite broadcast signal, said assembly including a housing, a low noise amplifier within said housing for receiving and amplifying said satellite broadcast signal, and a dish antenna arranged with respect to said low noise amplifier so as to convergingly reflect said satellite broadcast signal toward said low noise amplifier;

adjustment guidance means provided within said housing for emitting an adjustment signal that is responsive to a characteristic of said satellite broadcast signal received by said low noise amplifier to provide an indication of the orientation of said antenna assembly; and switch means for selectively activating said adjustment guidance means comprising a switch element provided within said housing and switch control means disposed externally of said housing, said switch element having a plurality of states and said switch control means being operable to select the state of said switch element without a mechanical connection between said switch element and said switch control means.

2. A satellite antenna according to claim 1; wherein said adjustment signal is perceptible to an individual who is in physical contact with said satellite antenna for the purpose of adjusting an orientation of said antenna assembly.

3. A satellite antenna according to claim 2; wherein said adjustment signal is in the form of sounds that are audible to said individual in physical contact with said satellite antenna.

4. A satellite antenna according to claim 3; wherein said adjustment signal is a sequence of audible tone signals.

5. A satellite antenna according to claim 4; wherein a variable time interval is provided between said tone signals of said sequence of audible tone signals, said variable time interval being varied in dependence on said characteristic of said satellite broadcast signal received by said low noise amplifier.

6. A satellite antenna according to claim 4; wherein said tone signals are all at the same tone frequency.

7. A satellite antenna according to claim 4; wherein said tone signals all have the same duration.

8. A satellite antenna according to claim 1; wherein said switch element comprises a magnetic lead switch.

* * * * *